US008417165B2

(12) United States Patent
Kasuya

(10) Patent No.: US 8,417,165 B2
(45) Date of Patent: Apr. 9, 2013

(54) IMAGE FORMING APPARATUS

(75) Inventor: Yoshisuke Kasuya, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 507 days.

(21) Appl. No.: 12/498,014

(22) Filed: Jul. 6, 2009

(65) Prior Publication Data

US 2010/0196028 A1 Aug. 5, 2010

(30) Foreign Application Priority Data

Jan. 30, 2009 (JP) ..... 2009-020432

(51) Int. Cl.
*G03G 15/00* (2006.01)

(52) U.S. Cl. ..... 399/308; 399/46; 399/54; 399/299

(58) Field of Classification Search ..... 399/42–46, 399/53, 54, 110–112, 116, 119, 298–300, 399/302, 308
See application file for complete search history.

(56) References Cited

U.S. PATENT DOCUMENTS

| | | | | |
|---|---|---|---|---|
| 6,934,497 | B2 | 8/2005 | Hagiwara et al. | |
| 7,106,981 | B2 | 9/2006 | Hashimoto et al. | |
| 7,200,350 | B2 | 4/2007 | Agata et al. | |
| 2005/0069334 | A1 | 3/2005 | Hashimoto et al. | |
| 2005/0152716 | A1 * | 7/2005 | Agata et al. | 399/223 |
| 2007/0048011 | A1 * | 3/2007 | Okubo | 399/128 |
| 2008/0317518 | A1 * | 12/2008 | Fukuhara | 399/302 |
| 2009/0269104 | A1 * | 10/2009 | Mochizuki | 399/167 |

FOREIGN PATENT DOCUMENTS

| | | | |
|---|---|---|---|
| JP | 2001-142312 | A | 5/2001 |
| JP | 2003-337454 | A | 11/2003 |
| JP | 2005-99436 | A | 4/2005 |
| JP | 2005-107407 | A | 4/2005 |
| JP | 2005-222035 | A | 8/2005 |
| JP | 3943758 | B2 | 7/2007 |
| JP | 2009-175439 | A | 8/2009 |

OTHER PUBLICATIONS

Notification of Reasons for Refusal issued Dec. 18, 2012, in Japanese Application No. 2009-020432.

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus which attains a high quality image by suppressing fluctuation in speed of an intermediate transfer belt generated when a leading edge of a recording material having high rigidity such as a thick sheet is brought into contact with the belt in a single color mode. The single color mode is switched between a first single color mode in which a toner image on one photosensitive drum is primarily transferred onto the belt with only the one drum being in contact with the belt, and the toner image on the belt is secondarily transferred onto the recording material, and a second single color mode in which a toner image born on one of drums is primarily transferred onto the belt with the drums being in contact with the belt, and the toner image on the belt is secondarily transferred onto the recording material.

24 Claims, 7 Drawing Sheets

IMAGE FORMING APPARATUS

BACKGROUND OF THE INVENTION

1. Field of the Invention

The present invention relates to an image forming apparatus such as a copying machine and a printer, which is provided with a function of forming an image on a recording material such as a sheet.

2. Description of the Related Art

Recently, as an image forming apparatus such as a printer and a copying machine using an electrophotographic method, there is widely used a tandem type image forming apparatus capable of forming a color image on various kinds of recording materials at high speed with high quality.

For example, the tandem type image forming apparatus has a structure in which four image forming units for yellow (Y), magenta (M), cyan (C), and black (K) are arranged in parallel with each other, and an intermediate transfer belt is circulated so as to be sequentially brought into contact with photosensitive drums of the image forming units. Then, onto the circulating intermediate transfer belt, toner images of yellow, magenta, cyan, and black colors are sequentially formed by the image forming units, and primarily transferred thereonto in a multiple transfer manner. After that, the toner images are collectively secondarily transferred onto a recording material by the intermediate transfer belt and a secondary transfer member. Finally, the toner images on the recording material are fixed, whereby the color image is formed.

Generally, in the image forming apparatus capable of forming a multiple color image, a multiple color mode in which all the image forming units function and a single color mode in which only one of the image forming units functions can be selectively carried out.

In the above-mentioned tandem type image forming apparatus capable of switching between the multiple color mode and the single color mode, if the photosensitive drums of the image forming units, which do not function at the time of image formation in the single color mode, continue to be in contact with the intermediate transfer belt, there is a fear that the following problem arises. That is, surfaces of the photosensitive drums are worn due to contact with the intermediate transfer belt.

Thus, Japanese Patent Application Laid-Open No. 2003-337454 proposes a structure in which the photosensitive drums of the image forming units, which do not function in the single color mode, are separated from the intermediate transfer belt. FIGS. 8A and 8B are schematic sectional views of the structure of the image forming apparatus. FIG. 8A illustrates a state when image formation is performed in the multiple color mode, and FIG. 8B illustrates a state when image formation is performed in the single color mode. In the multiple color mode, as illustrated in FIG. 8A, the image formation is performed on a recording material S in a state in which all photosensitive drums 103*a*, 103*b*, 103*c*, and 103*d* are brought into contact with an intermediate transfer belt 108. In the single color mode, as illustrated in FIG. 8B, the image formation is performed on the recording material S in a state in which only the photosensitive drum 103*d* is brought into contact with the intermediate transfer belt 108.

Further, Japanese Patent No. 3,943,758 proposes an image forming apparatus which conveys the recording material while the recording material is attracted to an electrostatic conveying belt, and transfers the toner images formed on the photosensitive drums to the recording material to thereby perform recording. The photosensitive drums of the image forming units, which do not function in the single color mode, are separated from the electrostatic conveying belt.

However, in a tandem color image forming apparatus capable of switching a position of the intermediate transfer belt between the multiple color mode and the single color mode, a restraint force of the intermediate transfer belt is weakened in the single color mode. Thus, there is a fear that an image formation defect is generated.

That is, in the multiple color mode, the intermediate transfer belt is sandwiched between the photosensitive drums of the multiple image forming units and transfer rollers, and is restrained at many portions (points) to stably circulate and move therearound. Meanwhile, in the single color mode, the intermediate transfer belt is sandwiched only at one point between a photosensitive drum of a black image forming unit and a transfer roller, and the points for restraining the intermediate transfer belt are reduced. Thus, it becomes easy to generate fluctuation in circulating speed of the intermediate transfer belt.

For example, when the recording material having high rigidity such as a thick sheet proceeds onto the intermediate transfer belt, fluctuation in speed of the intermediate transfer belt is generated due to impact. In this case, if the image is transferred onto the intermediate transfer belt from the photosensitive drum of the black image forming unit, density of the toner image is changed, and hence there is a risk that disorder of the image is generated at the portion thereof.

SUMMARY OF THE INVENTION

The present invention has been made in view of the above-mentioned circumstances, and an object of the present invention is therefore to provide an image forming apparatus which suppresses fluctuation in speed of an intermediate transfer belt generated when a leading edge of a recording material is brought into contact with the intermediate transfer belt, to thereby attain a high quality image.

It is an object of the present invention to provide an image forming apparatus, comprising:

a movable intermediate transfer belt;

a rotatable first image bearing member; and a rotatable second image bearing member, wherein the second image bearing member is configured to be separable from and in pressure contact with the intermediate transfer belt, wherein the image forming apparatus is operable in a multiple color mode in which in a state in which both the first image bearing member and the second image bearing member bear toner images, respectively, and both the first image bearing member and the second image bearing member are in contact with the intermediate transfer belt, the toner images are primarily transferred onto the intermediate transfer belt from both the first image bearing member and the second image bearing member, and the toner images, which have been transferred onto the intermediate transfer belt, are collectively secondarily transferred onto a recording material, wherein the image forming apparatus is operable in a single color mode in which the first image bearing member bears a toner image and the second image bearing member bears no toner image, the toner image is primarily transferred onto the intermediate transfer belt from the first image bearing member, and the toner image, which has been transferred onto the intermediate transfer belt, is secondarily transferred onto a recording material, and wherein the single color mode comprises:

a first mode in which in a state in which the first image bearing member is in contact with the intermediate transfer belt and the second image bearing member is separated from the intermediate transfer belt, the toner image is primarily transferred onto the intermediate transfer belt from the first image bearing member; and a second mode in which in a state in which the first image bearing member and the second image bearing member are in contact with the intermediate transfer belt, the toner image is primarily transferred onto the intermediate transfer belt.

Further features of the present invention will become apparent from the following description of exemplary embodiments with reference to the attached drawings.

DESCRIPTION OF THE EMBODIMENTS

Hereinafter, with reference to the drawings, exemplary embodiments of the present invention are described in detail. It should be noted that dimensions, materials, and shapes of components, and relative arrangement thereof, which are described in the following embodiments, may be appropriately modified in accordance with a structure and various conditions of an apparatus to which the present invention is applied. Therefore, as long as no particularly specific description is made, scope of the present invention should not construed restrictively.

(Embodiment 1)

Figure 1:
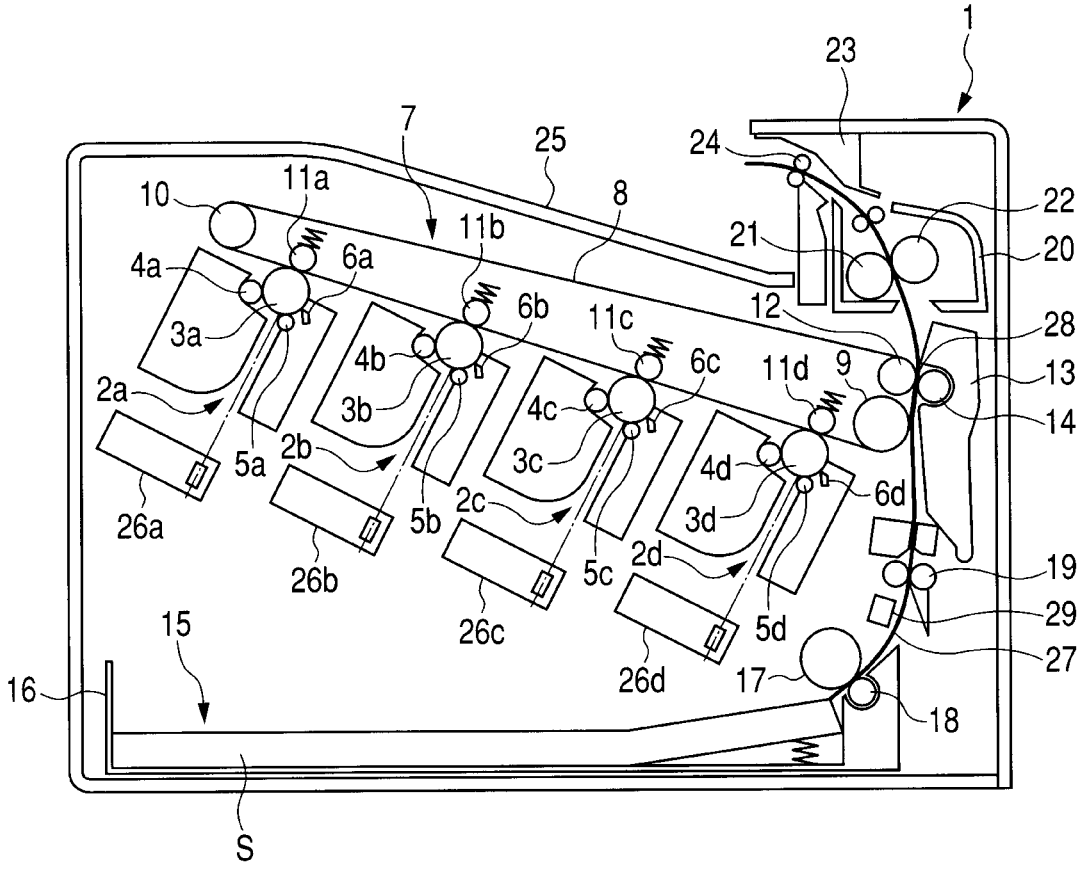
FIG. 1 is a schematic sectional view of a structure of an image forming apparatus according to Embodiment 1.

Hereinafter, an image forming apparatus according to Embodiment 1 of the present invention will be described. FIG. 1 is a schematic sectional view of a structure of a full-color image forming apparatus using an intermediate transfer belt serving as an intermediate transfer member.

As illustrated in FIG. 1, a plurality of image forming units 2*a*, 2*b*, 2*c*, and 2*d* configured to form toner images of respective colors are detachably mounted to a full-color image forming apparatus (hereinafter, referred to as an image forming apparatus) 1. The image forming apparatus 1 is provided with an intermediate transfer belt unit 7 including an intermediate transfer belt 8, and a fixing device 20.

Here, the image forming units 2*a*, 2*b*, 2*c*, and 2*d* include photosensitive drums 3*a*, 3*b*, 3*c*, and 3*d* serving as image bearing members, respectively. The photosensitive drums 3*a*, 3*b*, 3*c*, and 3*d* are rotatable. Around the photosensitive drums 3*a*, 3*b*, 3*c*, and 3*d*, charging rollers 5*a*, 5*b*, 5*c*, and 5*d* serving as charging members, developing rollers 4*a*, 4*b*, 4*c*, and 4*d* serving as developing members, and cleaning blades 6*a*, 6*b*, 6*c*, and 6*d* serving as cleaning units are integrally provided. The image forming units 2*a*, 2*b*, 2*c*, and 2*d* are arranged (provided) in parallel to each other in a moving direction of the intermediate transfer belt 8.

In the image forming units 2*a*, 2*b*, 2*c*, and 2*d*, the charging rollers 5*a*, 5*b*, 5*c*, and 5*d* are placed onto the outer peripheral surfaces of the photosensitive drums 3*a*, 3*b*, 3*c*, and 3*d*, respectively, and uniformly charge the surfaces of the photosensitive drums. Further, the developing rollers 4*a*, 4*b*, 4*c*, and 4*d* develop electrostatic latent images of respective colors formed on the surfaces of the photosensitive drums by exposure from laser exposing devices 26*a*, 26*b*, 26*c*, and 26*d* with use of toner of corresponding colors. Note that, the developing rollers 4*a*, 4*b*, 4*c*, and 4*d* are configured to separate from the photosensitive drums 3*a*, 3*b*, 3*c*, and 3*d* and stop their own rotation to prevent deterioration of toner (not shown). That is, the developing rollers 4*a*, 4*b*, 4*c*, and 4*d* are configured to be separable from and in pressure contact with the photosensitive drums 3*a*, 3*b*, 3*c*, and 3*d*. After the toner images are transferred, the cleaning blades 6*a*, 6*b*, 6*c*, and 6*d* remove transfer residual toner adhering to the surfaces of the photosensitive drums.

The intermediate transfer belt unit 7 includes the movable intermediate transfer belt 8, a drive roller 9 configured to drive the intermediate transfer belt 8, a tension roller 10 configured to apply tension to the intermediate transfer belt, and a secondary transfer opposed roller 12. The drive roller 9, the tension roller 10, and the secondary transfer opposed roller 12 also serve as stretching rollers configured to stretch the intermediate transfer belt. The intermediate transfer belt unit further includes primary transfer rollers 11*a*, 11*b*, 11*c*, and 11*d*. Further, by rotating and driving the drive roller 9 by a belt drive motor (not shown), the intermediate transfer belt 8 is rotated and moved. At positions of nipping the intermediate transfer belt 8 together with the photosensitive drums 3*a*, 3*b*, 3*c*, and 3*d*, the primary transfer rollers 11*a*, 11*b*, 11*c*, and 11*d*, which form primary transfer portions together with the photosensitive drums 3*a*, 3*b*, 3*c*, and 3*d*, are arranged so as to be opposed to the photosensitive drums. Further, at a position of nipping the intermediate transfer belt 8 together with the secondary transfer opposed roller 12, a secondary transfer roller 14, which forms a secondary transfer portion 28 together with the secondary transfer opposed roller 12, is arranged so as to be opposed to the secondary transfer opposed roller. The secondary transfer roller 14 is held by a transfer convey unit 13. Here, the primary transfer rollers 11*a*, 11*b*, 11*c*, and 11*d* are provided so as to be movable with respect to the intermediate transfer belt. The intermediate transfer belt 8 is configured to separate from the photosensitive drums 3*a*, 3*b*, 3*c*, and 3*d* by moving the primary transfer rollers 11*a*, 11*b*, 11*c*, and 11*d* in the intermediate transfer belt unit 7. As described above, the photosensitive drums 3*a*, 3*b*, 3*c*, and 3*d* and the intermediate transfer belt 8 are provided so as to be contactable and separable from each other.

In this embodiment, the primary transfer rollers 11*a*, 11*b*, 11*c*, and 11*d* are moved in conjunction with the fixing device. By connecting to a gear of a drive unit configured to drive the fixing device, a cam gear is rotated. The contact and separation of the primary transfer rollers are performed from the cam gear through a slider mechanism.

There may be adopted a structure in which the primary transfer rollers 11*a*, 11*b*, 11*c*, and 11*d* are moved from the primary transfer nip portions formed by the primary transfer rollers 11*a*, 11*b*, 11*c*, and 11*d* together with the photosensitive drums 3*a*, 3*b*, 3*c*, and 3*d* to thereby reduce abutting pressure of the intermediate transfer belt 8 against the photosensitive drums.

On a lower portion of the image forming apparatus, a feeding portion 15 configured to feed a recording material S to the secondary transfer portion 28 is arranged. The feeding portion 15 includes a feeding roller 17 configured to feed the recording material S from a feeding cassette 16 containing a plurality of the recording materials S, and a separation roller 18 serving as a separation unit. The recording materials S contained in the feeding cassette 16 are pressed by the feeding roller 17, and are separated one sheet by one sheet by the separation roller 18 and conveyed. The separated recording material S passes through a main body feeding conveying path 27 and is conveyed to a registration roller pair 19 to thereby being stopped temporarily. At this time, the thickness of the recording material S is detected by a detecting member 29. After that, the recording material S is conveyed to the secondary transfer portion 28 by the registration roller pair 19.

Here, the detecting member 29 includes a sensor configured to image a reflection image from a recording material surface to which light is, for example, obliquely irradiated and a penetration image from the recording material surface to which light is irradiated from a back surface of the recording material. The detecting member 29 is a member which calculates information related to an asperity condition and reflectance of the recording material surface based on the imaged reflection image, and information related to the thickness and transparency of the recording material based on the penetration image, thereby detecting a kind of the recording material S.

In this embodiment, there is provided a recording material discriminating portion configured to receive the detection result of the detecting member 29 and discriminate the thickness of the recording material based on the detection result of the detecting member 29. The recording material discriminating portion in this embodiment sets a predetermined thickness of the recording material as a "predetermined thickness", and discriminates whether the thickness of the recording material is larger than the predetermined thickness or not. Specifically, in response to the output of the detecting member 29, a controller (control portion) in the image forming apparatus discriminates the thickness of the recording material.

In the secondary transfer portion 28, by applying bias having positive polarity to the secondary transfer roller 14, a multiple-color toner image on the intermediate transfer belt is secondarily transferred onto the conveyed recording material S.

The fixing device 20 includes a fixing member 21 serving as a heating member and a pressure roller 22 serving as a pressure member. By pressure-contact between the fixing member 21 and the pressure roller 22, a fixing nip portion as a heating nip portion is formed.

The recording material S bearing an unfixed toner image is conveyed to the fixing nip portion, and is nipped and conveyed by the fixing nip portion, whereby the unfixed toner image is heated and thermally fixed. The recording material S having passed through the fixing nip portion is delivered to a delivery tray 25 by a delivery roller pair 24 provided in a delivery unit 23.

Next, an image forming operation of the image forming apparatus 1 having the above-mentioned structure will be described. In this embodiment, a printing mode (image forming mode) includes a multiple color mode in which development is performed using multiple colors (two or more colors) and a single color mode in which development is performed using a single color. In the single color mode, in accordance with the recording material and image quality, a first single color mode (corresponding to first mode) and a second single color mode (corresponding to second mode) can be selected.

Figure 2A:
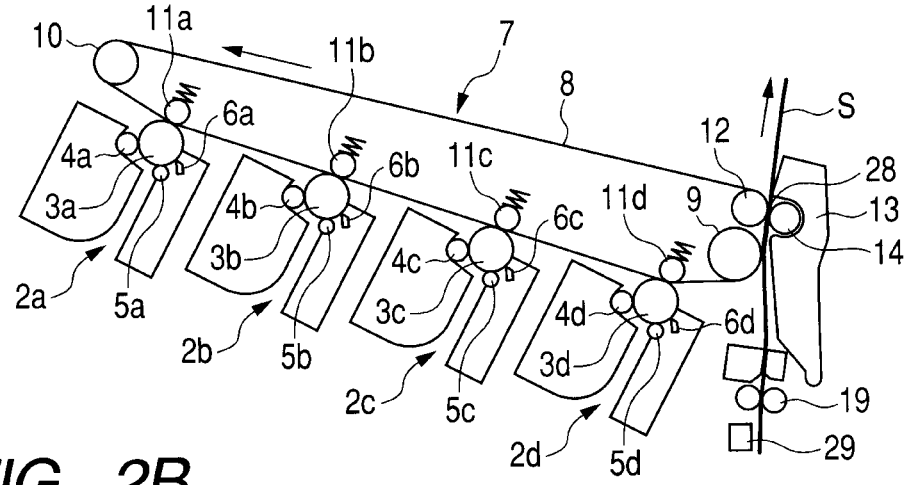
FIGS. 2A, 2B, and 2C are views illustrating image forming operations in respective modes.
Figure 2B:
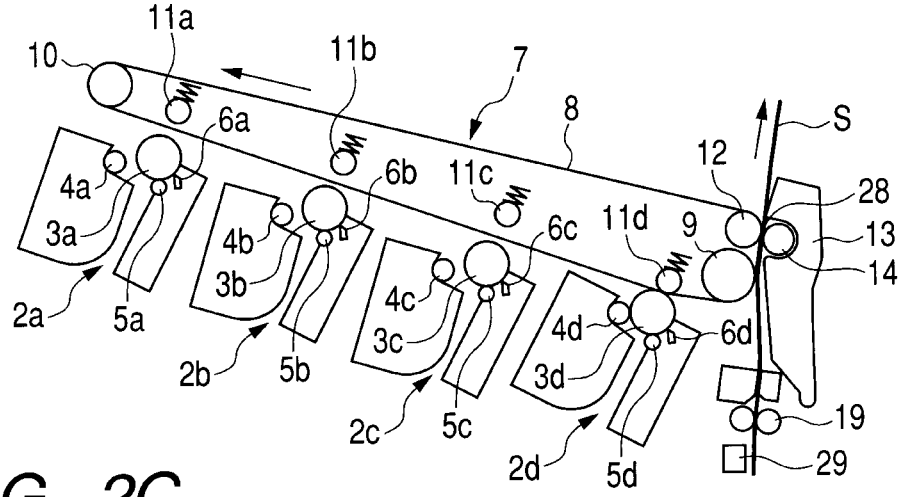
Figure 2C:
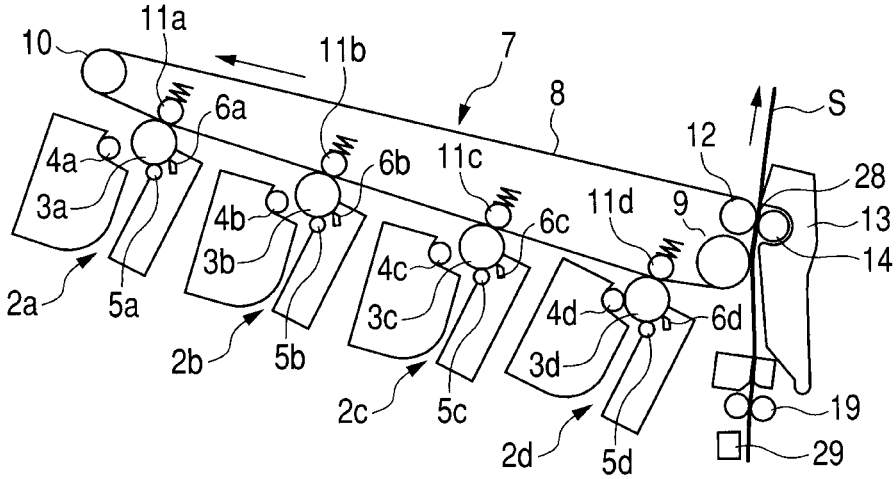

FIG. 2A is a view illustrating an image forming operation in the multiple color mode. FIG. 2B is a view illustrating an image forming operation in the first single color mode. FIG. 2C is a view illustrating an image forming operation in the second single color mode.

In the case of the multiple color mode, as illustrated in FIG. 2A, all the photosensitive drums 3*a*, 3*b*, 3*c*, and 3*d* abut against (are brought into contact with) the intermediate transfer belt 8, and all the developing rollers 4*a*, 4*b*, 4*c*, and 4*d* are operated, whereby development using multiple colors is performed. That is, a first photosensitive drum and a second photosensitive drum are in contact with the intermediate transfer belt 8.

At the time of the image forming operation, first, the surfaces of the photosensitive drums 3*a*, 3*b*, 3*c*, and 3*d* are uniformly charged by the charging rollers 5*a*, 5*b*, 5*c*, and 5*d*. The exposure is performed on the peripheral surfaces of the photosensitive drums 3*a*, 3*b*, 3*c*, and 3*d* in accordance with image signals by the laser exposing devices 26*a*, 26*b*, 26*c*, and 26*d*, and the electrostatic latent images are formed on the peripheral surfaces of the photosensitive drums 3*a*, 3*b*, 3*c*, and 3*d*. Voltage having the same charging polarity and substantially the same potential as those of the photosensitive drums 3*a*, 3*b*, 3*c*, and 3*d* is applied to the developing rollers 4*a*, 4*b*, 4*c*, and 4*d* such that toner adheres to the electrostatic latent images on the photosensitive drums 3*a*, 3*b*, 3*c*, and 3*d*, and the toner adheres to the electrostatic latent images, whereby development is performed.

The toner images formed on the photosensitive drums 3*a*, 3*b*, 3*c*, and 3*d* are sequentially primarily transferred onto the intermediate transfer belt 8 in the following operations. That is, the photosensitive drums 3*a*, 3*b*, 3*c*, and 3*d* are rotated clockwise in FIG. 2A, and the intermediate transfer belt 8 is rotated counterclockwise. In addition, bias having positive polarity is applied to the primary transfer rollers 11*a*, 11*b*, 11*c*, and 11*d*. As a result, the toner images are primarily transferred onto the intermediate transfer belt 8. After that, in a state in which the multiple-color toner images are superimposed on top of one another, the toner images are carried to the secondary transfer portion 28.

The recording materials S are separated one sheet by one sheet, and the separated recording material S is conveyed from the feeding portion 15 to be brought into contact with the registration roller pair 19, whereby the recording material S is stopped temporarily. The recording material S waited at the registration roller pair 19 is conveyed to the secondary transfer portion 28 by the registration roller pair 19. By applying bias to the secondary transfer roller 14, the toner images on the intermediate transfer belt 8 are collectively secondarily transferred onto the conveyed recording material S.

The recording material S, onto which the toner images are transferred, passes through the secondary transfer portion 28 and reaches the fixing device 20. After the toner images are thermally fixed onto the recording material S, the recording material S is delivered to the delivery tray 25 by the delivery roller pair 24.

Next, the single color mode (corresponding to second mode) in which development is performed using a single color will be described. The single color mode includes the first single color mode and the second single color mode. In the first single color mode and the second single color mode, there is a common point in that one photosensitive drum onto which a toner image is developed by a developing roller is used, and no toner image is developed onto other photosensitive drums by developing rollers.

That is, the first single color mode and the second single color mode are common in that a first image bearing member bears a toner image and a second image bearing member does not bear a toner image.

In the first single color mode, as illustrated in FIG. 2B, a plurality of primary transfer rollers 11*a*, 11*b*, and 11*c* in the intermediate transfer belt unit 7 are moved upward (separated from the intermediate transfer belt), and the photosensitive drums 3*a*, 3*b*, and 3*c* are separated from the intermediate transfer belt 8. Except for one photosensitive drum 3*d* (a first image bearing member), other photosensitive drums 3*a*, 3*b*, and 3*c* (second image bearing members) are moved to a position inability to transfer the toner image onto the intermediate transfer belt 8. In this embodiment, the photosensitive drum 3*d* is situated on the most downstream side in the moving direction of the intermediate transfer belt 8. Therefore, between the drive roller 9 and the tension roller 10, only the one photosensitive drum 3*d* (the first image bearing member) is in contact with the intermediate transfer belt 8.

In the first single color mode, only the image forming unit 2*d* is driven, and other image forming units 2*a*, 2*b*, and 2*c* are paused. In the image forming unit 2*d*, the charging roller 5*d* is provided on the outer peripheral surface of the photosensitive drum 3*d* (the first image bearing member), and uniformly charges the surface of the photosensitive drum 3*d*. Further, the developing roller 4*d* (a first developing member) develops, with use of toner, the electrostatic latent image formed on the surface of the photosensitive drum 3*d* by exposure from the laser exposing device 26*d*.

The photosensitive drum 3*d* is rotated clockwise in FIG. 2B, and the intermediate transfer belt 8 is rotated counterclockwise. In addition, bias having positive polarity is applied to the primary transfer roller 11*d*. As a result, the toner image formed on the photosensitive drum 3*d* is primarily transferred onto the intermediate transfer belt 8. Then, the single-color toner image is carried to the secondary transfer portion 28 while being formed on the intermediate transfer belt 8.

The recording materials S are separated one sheet by one sheet, and the separated recording material S is fed from the feeding portion 15 to be brought into contact with the registration roller pair 19, whereby the recording material S is stopped temporarily. At this time, the thickness of the recording material S is discriminated by the recording material discriminating portion. The recording material S waited at the registration roller pair 19 is conveyed to the secondary transfer portion 28 by the registration roller pair 19. By applying bias to the secondary transfer roller 14, the toner image on the intermediate transfer belt 8 is secondarily transferred onto the conveyed recording material S.

The recording material S, onto which the toner image has been transferred, passes through the secondary transfer portion 28 and reaches the fixing device 20. After the toner image is thermally fixed onto the recording material S, the recording material S is delivered to the delivery tray 25 by the delivery roller pair 24.

In the second single color mode, as in the case of the multiple color mode, as illustrated in FIG. 2C, the photosensitive drums 3*a*, 3*b*, 3*c*, and 3*d* are brought into contact with the intermediate transfer belt 8, whereby single-color printing is performed. That is, in the single color mode, the photosensitive drum 3*d* (the first image bearing member) bearing the toner image and the photosensitive drums 3*a*, 3*b*, and 3*c* (the second image bearing members) bearing no toner image are in contact with the intermediate transfer belt 8.

That is, in the second single color mode, the image forming units 2*a*, 2*b*, 2*c*, and 2*d* are driven, and the photosensitive drums 3*a*, 3*b*, 3*c*, and 3*d* are rotated and driven. The charging rollers 5*a*, 5*b*, 5*c*, and 5*d* are provided on the outer peripheral surfaces of the photosensitive drums 3*a*, 3*b*, 3*c*, and 3*d*, and uniformly charge the surfaces of the photosensitive drums 3*a*, 3*b*, 3*c*, and 3*d*, respectively. Further, the developing roller 4*d* (the first developing member) develops, with use of toner, the electrostatic latent image formed on the surface of the photosensitive drum 3*d* by exposure from the laser exposing device 26*d*.

The photosensitive drum 3*d* is rotated clockwise in FIG. 2C, and the intermediate transfer belt 8 is rotated counterclockwise. In addition, bias having positive polarity is applied to the primary transfer roller 11*d*. As a result, the toner image formed on the photosensitive drum 3*d* is primarily transferred onto the intermediate transfer belt 8. Then, the single-color toner image is carried to the secondary transfer portion 28 while being formed on the intermediate transfer belt 8.

Here, in this embodiment, as illustrated in FIG. 2C, the developing rollers 4*a*, 4*b*, and 4*c* (second developing members), which develop the toner images on the photosensitive drums 3*a*, 3*b*, and 3*c*, respectively, are separated from the photosensitive drums, and rotation thereof is stopped. The rotation of the developing rollers 4*a*, 4*b*, and 4*c* is stopped, whereby deterioration of toner (not shown) is prevented and abrasion due to unnecessary rotation of the developing rollers is suppressed.

The recording materials S are separated one sheet by one sheet, and the separated recording material S is conveyed from the feeding portion 15 to be brought into contact with the registration roller pair 19, whereby the recording material S is stopped temporarily. At this time, the thickness of the recording material S is discriminated by the recording material discriminating portion. The recording material S waited at the registration roller pair 19 is conveyed to the secondary transfer portion 28 by the registration roller pair 19. By applying bias to the secondary transfer roller 14, the toner image on the intermediate transfer belt 8 is secondarily transferred onto the conveyed recording material S.

The recording material S, onto which the toner image has been transferred, passes through the secondary transfer portion 28 and reaches the fixing device 20. After the toner image is thermally fixed onto the recording material S, the recording material S is delivered to the delivery tray 25 by the delivery roller pair 24.

In the second single color mode, the photosensitive drums 3*a*, 3*b*, and 3*c* (the second image bearing members) bear no toner image. Therefore, without transferring toner onto the intermediate transfer belt 8, the photosensitive drums 3*a*, 3*b*, and 3*c* are rotated while being brought into contact with the intermediate transfer belt 8, and hence a restraint force of the intermediate transfer belt 8 is not reduced.

Figure 3:
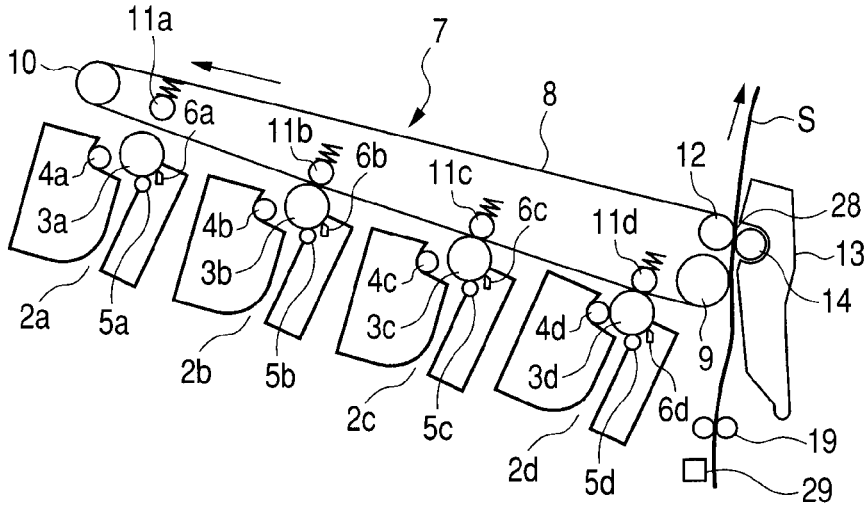
FIG. 3 is a view illustrating an image forming operation of a second mode in a single color mode.

Further, within a range in which it is possible to suppress the reduction of the restraint force of the intermediate transfer belt 8, it is unnecessary that all the second image bearing members are brought into contact with the intermediate transfer belt. For example, as illustrated in FIG. 3, even in the second single color mode, not all the second image bearing members may be brought into contact with the intermediate transfer belt 8 in some cases. (The photosensitive drum 3*a* serving as the second image bearing member illustrated in FIG. 3 is separated from the intermediate transfer belt.)

Next, a method of selecting the first single color mode and the second single color mode will be described.

In this embodiment, in the case where the recording material S is a normal sheet (plain paper), a thin sheet, or the like, and normal single-color printing is performed, the first single color mode is selected and recording is performed. This is because impact is small when the recording material S comes into the secondary transfer portion 28 between the secondary transfer opposed roller 12 and the secondary transfer roller 14, thereby making it difficult to generate fluctuation in speed of the intermediate transfer belt 8. Therefore, if there is selected the first single color mode in which the restraint force of the intermediate transfer belt 8 is reduced, it is low probability that a change in density of the toner image causes disorder of the image at a portion of the toner image in which its density is changed. Therefore, even in the case of the first single color mode, it is possible to obtain a high quality image.

In contrast, in the case where the recording material S having high rigidity such as a thick sheet is used, the fluctuation in speed of the intermediate transfer belt 8 is large, which is generated when the recording material S comes into the secondary transfer portion 28 between the secondary transfer opposed roller 12 and the secondary transfer roller 14. Thus, there is selected the second single color mode in which the restraint force of the intermediate transfer belt 8 is not reduced.

Figure 4:
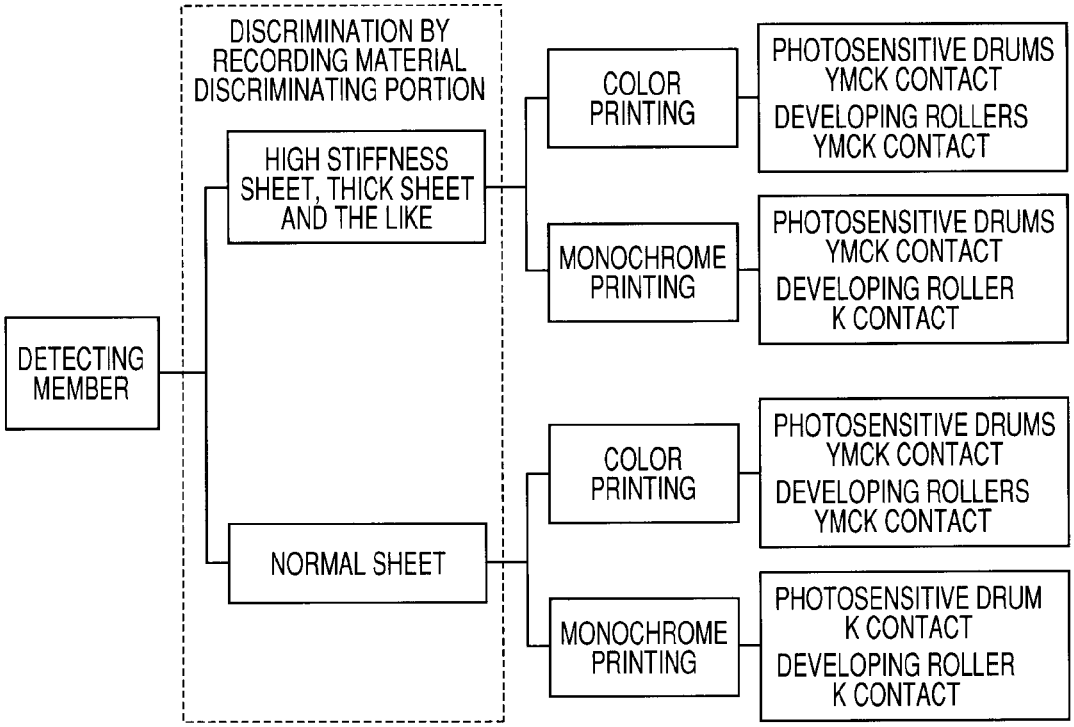
FIG. 4 is a block diagram illustrating a structure in which a recording mode is discriminated based on a signal from a detecting member.

Here, the fluctuation in speed of the intermediate transfer belt depends on the restraint force against the intermediate transfer belt by the photosensitive drums 3*a*, 3*b*, and 3*c*, and is not affected by contact and separation of the developing rollers 4*a*, 4*b*, and 4*c* with respect to the photosensitive drums. Therefore, in this embodiment, as illustrated in FIG. 2C, the developing rollers 4*a*, 4*b*, and 4*c* (the second developing members), which develop the toner images on the photosensitive drums 3*a*, 3*b*, and 3*c*, respectively, are separated from the photosensitive drums, and rotation thereof is stopped. FIG. 4 is a block diagram illustrating a structure in which a printing mode is switched (selected, set) based on a signal from the recording material discriminating portion.

In this embodiment, as illustrated in FIG. 4, the recording material discriminating portion detects the thickness of the recording material based on the signal from the detecting member configured to detect the kind of the recording material S, whereby a mode switching portion, which is provided in the image forming apparatus, switches which printing mode to be selected among the above-mentioned printing modes when recording is performed.

In this embodiment, the mode switching portion is the controller (control portion) in the image forming apparatus. (That is, in this embodiment, the recording material discriminating portion and the mode switching portion are executed with one controller.)

Figure 5:
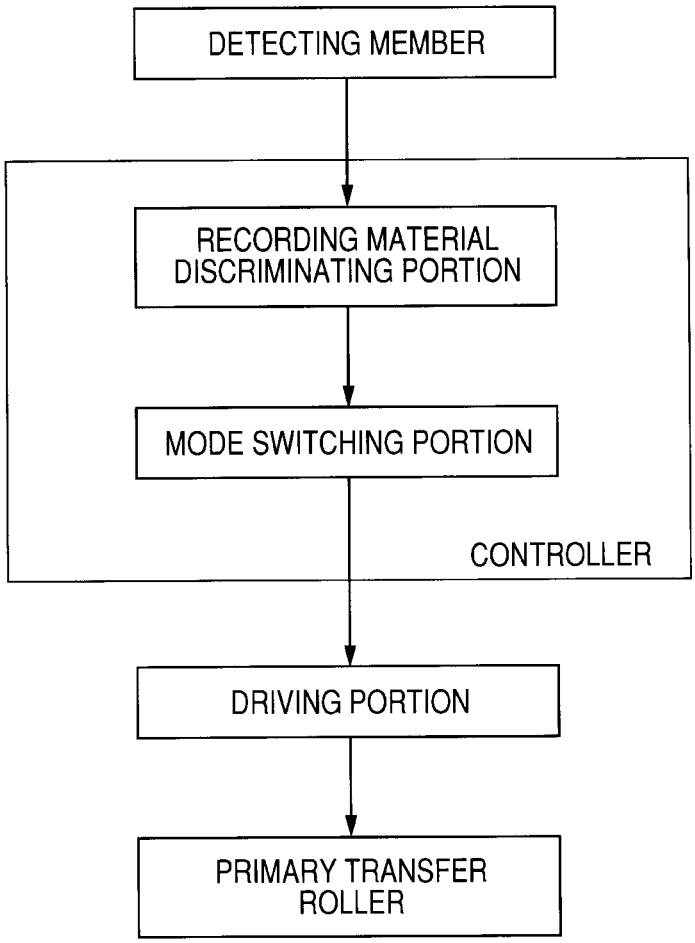
FIG. 5 is a block diagram of Embodiment 1.

Then, in the case of multiple-color printing, the mode switching portion is controlled so as to select the multiple color mode regardless of the kind of the recording material S. Further, in the case of single-color printing, the mode switching portion is controlled so as to select the first single color mode when the recording material S is a normal sheet (plain paper) or the like, and to select the second single color mode when the recording material S is a thick sheet or the like having high rigidity. When any one of the first single color mode and the second single color mode is selected by the mode switching portion, a driving portion is driven by the controller. Here, the driving portion is a motor or a solenoid configured to move the primary transfer rollers. FIG. 5 illustrates a block diagram in this embodiment. As illustrated in FIG. 5, in this embodiment, the controller switches the printing mode based on the detection result of the detecting member to thereby move the primary transfer rollers.

As described above, in this embodiment, in the single color mode, in addition to the first single color mode used for normal single color recording, there is provided the second single color mode in which a restraint force of an intermediate transfer member is not reduced, without adding other special mechanism. Further, there is configured the structure in which any one of the first single color mode and the second single color mode can be selected. In the second single color mode, the photosensitive drums 3*a*, 3*b*, and 3*c* are rotated while being brought into contact with the intermediate transfer belt without transferring toner, and hence the restraint force of the intermediate transfer belt 8 is not reduced unlike the case of the first single color mode. Therefore, even when the recording material S having high rigidity such as a thick sheet is used, it is possible to suppress occurrence of image failure, which is a problem when the recording material S comes into the secondary transfer portion 28 between the secondary transfer opposed roller 12 and the secondary transfer roller 14.

Note that, the first image bearing member may be configured so as to be separable from and in pressure contact with the intermediate transfer belt, and to be separated therefrom when the first image bearing member does not perform image formation in pre-rotation or the like. By the separation, it is possible to suppress abrasion caused by sliding friction between the image bearing member and the intermediate transfer belt.

(Embodiment 2)

In Embodiment 1 described above, there is described the case where the recording material discriminating portion discriminates the thickness of the recording material S based on the detection result from the detecting member 29 which detects the kind of the recording material S and is provided in the image forming apparatus, whereby the first single color mode and the second single color mode are switched.

In contrast, in Embodiment 2, there will be described the case where a user sets (selects) image quality and the kind of the recording material. Here, the case where the user sets (selects) image quality and the kind of the recording material refers to, for example, the case where the user selects the recording mode by a host computer connected to the image forming apparatus, and the case where the user selects the recording mode with use of an operation panel provided on the image forming apparatus. Note that, in this embodiment, only components different from those of Embodiment 1 will be described. Description of the same components as those of Embodiment 1 is omitted.

Figure 6:
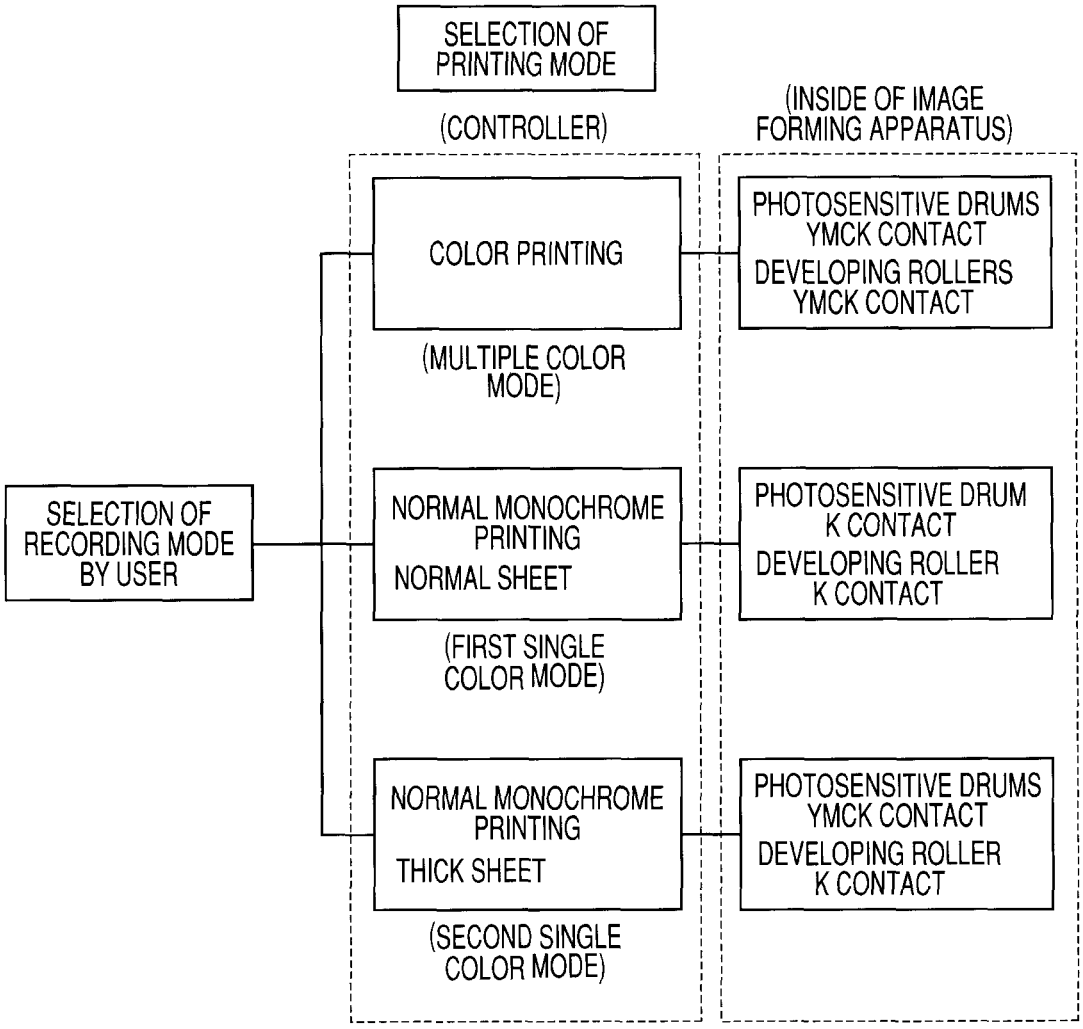
FIG. 6 is a block diagram of Embodiment 2.

FIG. 6 is a block diagram illustrating the case where the recording mode is selected by the user.

The user selects the recording mode by the host computer connected to the image forming apparatus. The recording mode includes color printing, normal monochrome printing (normal sheet), and normal monochrome printing (thick sheet). When the user selects a color printing mode, the controller (control portion) of the image forming apparatus selects the multiple color mode in response to the output from the host computer. After that, by the control of the controller, all the primary transfer rollers are moved so as to be brought into contact with the intermediate transfer belt.

When the user selects a normal monochrome printing (thick sheet) mode, the controller (recording material discriminating portion and switching portion) of the image forming apparatus discriminates the recording material and selects the second single color mode (second mode) in response to the output from the host computer.

In the second single color mode, the photosensitive drums 3*a*, 3*b*, and 3*c* are rotated while being brought into contact with the intermediate transfer belt without transferring toner, and hence the restraint force of the intermediate transfer belt 8 is not reduced unlike the case of the first single color mode (first mode). Therefore, even when the recording material S having high rigidity such as a thick sheet is used, it is possible to suppress occurrence of image failure, which is a problem when the recording material S comes into the secondary transfer portion 28 between the secondary transfer opposed roller 12 and the secondary transfer roller 14.

Further, the controller may discriminate the recording material in response to the output from the host computer. However, an instruction portion such as an operation panel allowing selection of the recording mode may be provided to the image forming apparatus, whereby the controller may discriminate the recording material in response to the output from the instruction portion.

(Embodiment 3)

In Embodiments 1 and 2 described above, there is described the case where the first single color mode and the second single color mode are switched by discriminating the kind (thickness) of the recording material S. In contrast, in Embodiment 3, there will be described the case where the first single color mode (first mode) and the second single color mode (second mode) are switched in accordance with image quality to be output.

As described above, in the second single color mode, the first image bearing member and the second image bearing members are brought into contact with the intermediate transfer belt, and hence there are a lot of restraint points. Thus, while generation of the fluctuation in speed at the intermediate transfer belt is suppressed, there is a risk of decreasing throughput in the following case. For example, when the monochrome printing is continuously performed on a plurality of normal sheets, the image formation is performed on the plurality of the normal sheets in the first single color mode. After that, when the monochrome printing is performed on only one thick sheet, the second single color mode is selected for the one thick sheet. In this case, for switching to the second single color mode, it is necessary to move the primary transfer rollers, and hence the image formation performed on the thick sheet is not started until the movement thereof is completed. As a result, the throughput is decreased.

Figure 7:
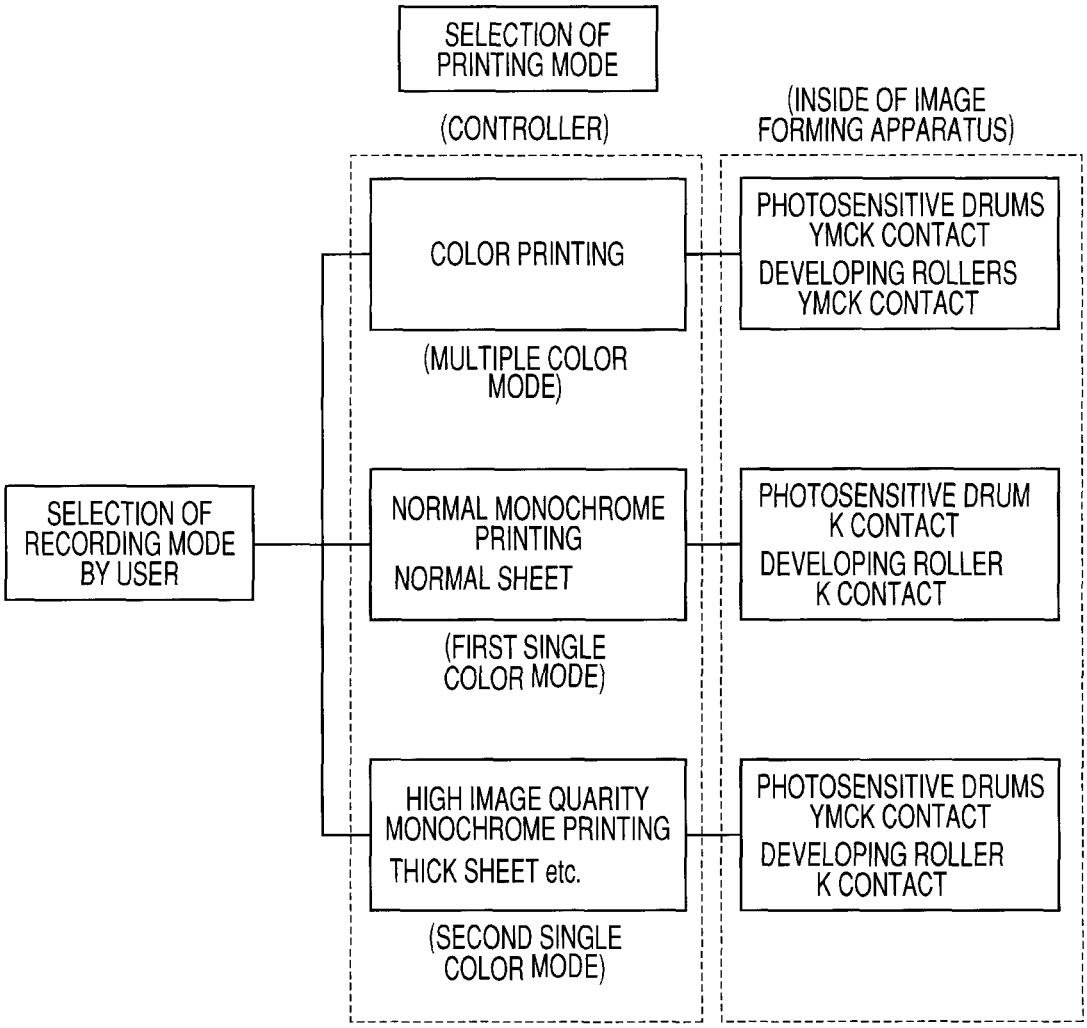
FIG. 7 is a block diagram of Embodiment 3.
Figure 8A:
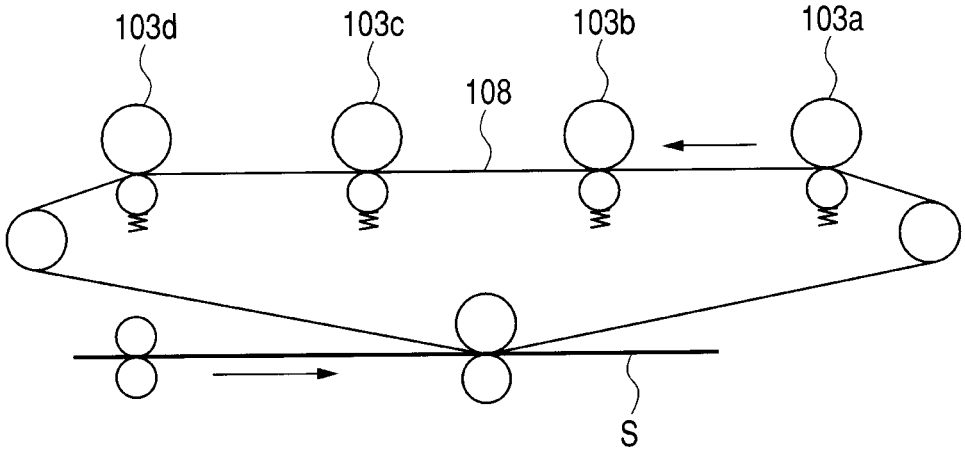
FIGS. 8A and 8B are schematic sectional views of a structure of a conventional image forming apparatus.
Figure 8B:
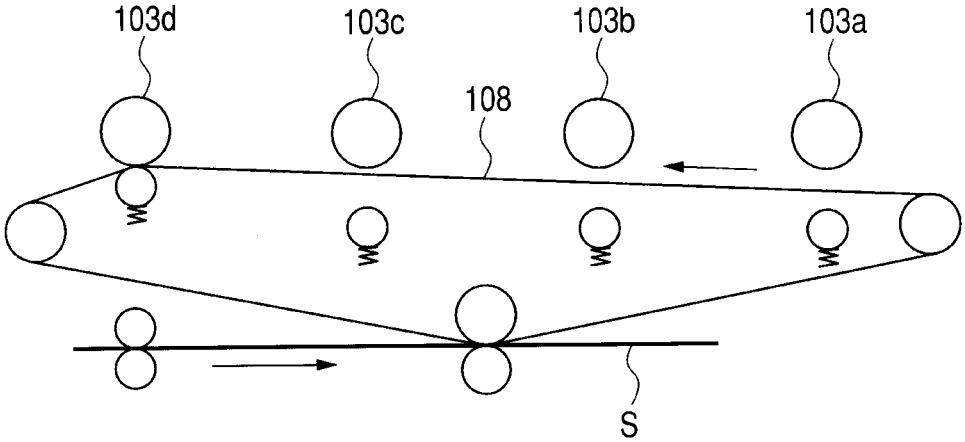

Therefore, in this embodiment, as illustrated in FIG. 7, the controller selects the first single color mode and the second single color mode in accordance with an image quality mode.

The user selects the recording mode by the host computer connected to the image forming apparatus. The recording mode is, for example, a color printing, a normal monochrome printing, or a high image quality monochrome printing. When the user selects the normal monochrome printing, the controller of the image forming apparatus selects the first single color mode in response to the output from the host computer. As a result, regardless of the thickness of the recording material, it is possible to always set the first single color mode, and to suppress a decrease in throughput.

When the user selects the high image quality monochrome printing mode, the controller of the image forming apparatus selects the second single color mode in response to the output from the host computer. As a result, regardless of the thickness of the recording material, it is possible to always set the second single color mode, and to suppress the fluctuation in speed of the intermediate transfer belt to thereby obtain a high quality image.

In this embodiment, the first single color mode and the second single color mode are not switched in the single color mode, and hence it is possible to suppress the decrease in throughput.

Further, the controller may discriminate the recording material in response to the output from the host computer. However, an instruction portion such as an operation panel allowing selection of the recording mode may be provided on the image forming apparatus, whereby the controller may switch the printing mode in response to the output from the instruction portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-020432, filed Jan. 30, 2009, which is hereby incorporated by reference herein in its entirety.

What is claimed is:

1. An image forming apparatus in which a toner image primarily transferred from an image bearing member to an intermediate transfer belt is secondarily transferred from the intermediate transfer belt to a recording material, comprising:

a movable endless intermediate transfer belt;

a rotatable first image bearing member;

a first developing member which develops a toner image on the first image bearing member, and is contactable to and separable from the first image bearing member;

a rotatable second image bearing member which is contactable to and separable from the intermediate transfer belt;

a second developing member which develops a toner image on the second image bearing member, and is contactable to and separable from the second image bearing member;

a stretching member configured to stretch the intermediate transfer belt; and a secondary transfer member opposed to the stretching member through the intermediate transfer belt in contact with an outer peripheral surface of the intermediate transfer belt, the secondary transfer member forming a secondary transfer portion together with the stretching member through the intermediate transfer belt, and the secondary transfer member transferring a toner image to a recording material proceeding into the secondary transfer portion, wherein the image forming apparatus is operable in a multiple color mode of transferring toner images from the first image bearing member and the second image bearing member to the intermediate transfer belt in a state in which the first image bearing member and the second image bearing member are in contact with the intermediate transfer belt, and in a single color mode of transferring the toner image from only the first image bearing member to the intermediate transfer belt in a state in which at least the first image bearing member is in contact with the intermediate transfer belt, and wherein in the single color mode, the toner image is transferred from the first image bearing member to the intermediate transfer belt when the recording material proceeds to the secondary transfer portion, the single color mode is further switchable to a plurality of modes, and one of the plurality of modes is a first mode of transferring the toner image from only the first image bearing member to the intermediate transfer belt in a state in which the first image bearing member is in contact with the first developing member and the intermediate transfer belt and in which the second image bearing member is separated from the second developing member and in contact with the intermediate transfer belt.

2. An image forming apparatus according to claim 1, wherein another of the plurality of modes is a second mode of transferring the toner image from only the first image bearing member to the intermediate transfer belt in a state in which the first image bearing member is in contact with the first developing member and the intermediate transfer belt and in which the second image bearing member is separated from the second developing member and separated from the intermediate transfer belt.

3. An image forming apparatus according to claim 2, wherein, when image formation is performed on the recording material in the single color mode, the image formation is performed in the first mode in a case of the image formation on the recording material having a thickness equal to or smaller than a predetermined thickness, and the image formation is performed in the second mode in a case of the image formation on the recording material having a thickness larger than the predetermined thickness.

4. An image forming apparatus according to claim 2, further comprising a recording material discriminating portion configured to discriminate whether a thickness of the recording material is equal to or smaller than a predetermined thickness or larger than the predetermined thickness, wherein, when image formation is performed on the recording material in the single color mode, the image formation is performed in the first mode when the recording material discriminating portion discriminates that the thickness of the recording material is equal to or smaller than the predetermined thickness, and the image formation is performed in the second mode when the recording material discriminating portion discriminates that the thickness of the recording material is larger than the predetermined thickness.

5. An image forming apparatus according to claim 4, further comprising a detecting member configured to detect the thickness of the recording material, wherein the recording material discriminating portion discriminates the thickness of the recording material based on a detection result of the detecting member.

6. An image forming apparatus according to claim 2, further comprising a control portion adapted to select between the first mode and the second mode when image formation is performed on the recording material in the single color mode.

7. An image forming apparatus according to claim 6, wherein, when the image formation is performed on the recording material in the single color mode, the control portion selects the first mode in a case of the image formation on the recording material having a thickness equal to or smaller than a predetermined thickness, and selects the second mode in a case of the image formation on the recording material having a thickness larger than the predetermined thickness.

8. An image forming apparatus according to claim 6, wherein, when the image formation is performed on the recording material in the single color mode, the control portion selects the first mode in a case of the image formation with a first image quality, and selects the second mode in a case of the image formation with a higher image quality than the first image quality.

9. An image forming apparatus according to claim 8, further comprising an image quality setting portion by which a user sets whether an image quality when the image formation is performed on the recording material is the first image quality or the higher image quality.

10. An image forming apparatus according to claim 1, wherein the first image bearing member and the second image bearing member each comprises a rotatable photosensitive drum.

11. An image forming apparatus according to claim 1, wherein the first developing member and the second developing member each comprises a rotatable developing roller.

12. An image forming apparatus according to claim 1, wherein the first image bearing member is configured to be separable from and in pressure contact with the intermediate transfer belt.

13. An image forming apparatus according to claim 1, wherein the first image bearing member and the second image bearing member are arranged in tandem below the intermediate transfer belt, and the first image bearing member is arranged downstream of the second image bearing member in a rotation direction of the intermediate transfer belt.

14. An image forming apparatus in which a toner image primarily transferred from an image bearing member to an intermediate transfer belt is secondarily transferred from the intermediate transfer belt to a recording material, comprising:

a movable endless intermediate transfer belt;

a first image bearing member which bears a black toner image;

a plurality of second image bearing members which are contactable to and separable from the intermediate transfer belt, and which bear color toner images;

a stretching member configured to stretch the intermediate transfer belt; and a secondary transfer member opposed to the stretching member through the intermediate transfer belt in contact with an outer peripheral surface of the intermediate transfer belt, the secondary transfer member forming a secondary transfer portion together with the stretching member through the intermediate transfer belt, and the secondary transfer member transferring a toner image to a recording material proceeding into the secondary transfer portion, wherein the image forming apparatus is operable in a multiple color mode of transferring toner images from the first image bearing member and the second image bearing members to the intermediate transfer belt in a state in which the first image bearing member and the second image bearing members are in contact with the intermediate transfer belt, and in a single color mode of transferring the toner image from only the first image bearing member to the intermediate transfer belt in a state in which at least the first image bearing member is in contact with the intermediate transfer belt, and wherein in the single color mode, the toner image is transferred from the first image bearing member to the intermediate transfer belt when the recording material proceeds to the second transfer portion, the single color mode is further switchable to a plurality of modes, and one of the plurality of modes is a first mode of transferring the toner image from only the first image bearing member to the intermediate transfer belt in a state in which all of the first image bearing member and the second image bearing members are in contact with the intermediate transfer belt.

15. An image forming apparatus according to claim 14, wherein another of the plurality of modes is a second mode of transferring the toner image from only the first image bearing member to the intermediate transfer belt in a state in which the first image bearing member is in contact with the intermediate transfer belt and in which the plurality of second image bearing members are separated from the intermediate transfer belt.

16. An image forming apparatus according to claim 14, further comprising a plurality of developing members which are contactable to and separable from the plurality of second image bearing members, respectively, wherein the plurality of developing members are separated from the second image bearing members when the first mode is performed.

17. An image forming apparatus according to claim 15, wherein, when image formation is performed on a recording material in the single color mode, the image formation is performed in the first mode in a case of the image formation on the recording material having a thickness equal to or smaller than a predetermined thickness, and the image formation is performed in the second mode in a case of the image formation on the recording material having a thickness larger than the predetermined thickness.

18. An image forming apparatus according to claim 14, wherein the first image bearing member and the second image bearing members are arranged in tandem below the intermediate transfer belt, and the first image bearing member is arranged downstream of the second image bearing members in a rotation direction of the intermediate transfer belt.

19. An image forming apparatus in which a toner image primarily transferred from an image bearing member to an intermediate transfer belt is secondarily transferred from the intermediate transfer belt to a recording material, comprising:

a movable endless intermediate transfer belt;

a first image bearing member which bears a toner image;

a plurality of second image bearing members which are contactable to and separable from the intermediate transfer belt, and which bear toner images, the plurality of second image bearing members being disposed upstream of the first image bearing member in a movement direction of the intermediate transfer belt;

a stretching member configured to stretch an inner peripheral surface of the intermediate transfer belt;

a secondary transfer member opposed to the stretching member through the intermediate transfer belt in contact with an outer peripheral surface of the intermediate transfer belt, the secondary transfer member forming a secondary transfer portion together with the stretching member through the intermediate transfer belt, and the secondary transfer member transferring a toner image to a recording material proceeding into the secondary transfer portion; and a drive member configured to move the intermediate transfer belt while stretching the inner peripheral surface of the intermediate transfer belt, the drive member being disposed downstream of an area in which the intermediate transfer belt is in contact with the first image bearing member and upstream of an area in which the intermediate transfer belt is in contact with the secondary transfer member in the movement direction of the intermediate transfer belt, wherein the image forming apparatus is operable in a multiple color mode of transferring toner images from the first image bearing member and the second image bearing members to the intermediate transfer belt in a state in which the first image bearing member and the second image bearing members are in contact with the intermediate transfer belt, and in a single color mode of transferring the toner image from only the first image bearing member to the intermediate transfer belt in a state in which at least the first image bearing member is in contact with the intermediate transfer belt, and wherein the single color mode is further switchable to a plurality of modes, and one of the plurality of modes is a first mode of transferring the toner image from only the first image bearing member to the intermediate transfer belt in a state in which all of the first image bearing member and the second image bearing members are in contact with the intermediate transfer belt.

20. An image forming apparatus according to claim 19, wherein the first image bearing member and the second image bearing members are arranged in tandem below the intermediate transfer belt.

21. An image forming apparatus according to claim 19, comprising a plurality of primary transfer members opposed to the first image bearing member and the plurality of second image bearing members, respectively, through the intermediate transfer belt in contact with the inner peripheral surface of the intermediate transfer belt.

22. An image forming apparatus according to claim 21, wherein the plurality of primary transfer members opposed to the plurality of second image bearing members are contactable to and separable from the intermediate transfer belt, and wherein the plurality of second image bearing members are contactable to and separable from the intermediate transfer belt by the opposed primary transfer members being contacted to and separated from the intermediate transfer belt.

23. An image forming apparatus according to claim 19, wherein, when image formation is performed on a recording material in the single color mode, the image formation is performed in the first mode in a case of the image formation on the recording material having a thickness equal to or smaller than a predetermined thickness, and the image formation is performed in the second mode in a case of the image formation on the recording material having a thickness larger than the predetermined thickness.

24. An image forming apparatus according to claim 19, further comprising a control portion adapted to select between the first mode and the second mode when image formation is performed on the recording material in the single color mode.

* * * * *